United States Patent [19]

Fiedler

[11] 4,170,205

[45] Oct. 9, 1979

[54] FUEL DISTRIBUTION IN INTERNAL COMBUSTION ENGINES

[76] Inventor: Willy A. Fiedler, 12758 Leander Dr., Los Altos Hills, Calif. 94022

[21] Appl. No.: 839,633

[22] Filed: Oct. 5, 1977

[51] Int. Cl.[2] ..... F02M 41/00

[52] U.S. Cl. ..... 123/139 AS; 123/139 AA; 123/32 ST

[58] Field of Search ..... 123/139 AS, 139 AV, 123/139 R, 139 AW, 139 AA, 32 ST, 32 SP, 33 B, 33 C, 33 E

[56] References Cited

U.S. PATENT DOCUMENTS

| | | | |
|---|---|---|---|
| 1,662,090 | 3/1928 | Vorhauer | 123/33 B |
| 3,102,521 | 9/1963 | Slemmons | 123/32 SP |
| 3,971,351 | 7/1976 | McKee | 123/139 AA |
| 4,006,725 | 2/1977 | Baczek et al. | 123/32 SP |

*Primary Examiner*—Charles J. Myhre
*Assistant Examiner*—Andrew M. Dolinar

[57] ABSTRACT

In a low-pressure fuel control system increments of fuel and air flow from a vented receptacle sequentially into multiple fuel valves which are either actuated or responding to air pressure differentials and the latter can also be used for spark ignition.

3 Claims, 3 Drawing Figures

FUEL DISTRIBUTION IN INTERNAL COMBUSTION ENGINES

BACKGROUND OF THE INVENTION

The invention relates to low-pressure fuel control in internal combustion engines metering the fuel flow according to operational and environmental conditions, apportioning the metered flow with vented fuel valves and expulsing increments of fuel and vent air into prechambers, as disclosed in application Ser. No. 638,086 filed on Dec. 5, 1975, now U.S. Pat. No. 4,068,626.

SUMMARY OF THE INVENTION

Improvements in the apportioning of a fuel flow and the distribution of increments are the concern of the invention. One object is an arrangement having one receptacle which is vented to ambient air, a manifold and multiple actuated fuel valves. Another object is a similar arrangement with fuel valves which during intake strokes open without the use of actuation elements in response to air pressure differentials. A further object is a fuel valve with the dual functions of fuel release and spark ignition. The elements needed to achieve the improvements are described.

DETAILED DESCRIPTION

Accurate metering of the fuel flow under all conditions and precise apportioning to the cylinders are prerequisite for reduced fuel consumption and emissions. The present invention offers arrangements for improved fuel apportioning and distribution.

Figure 1:
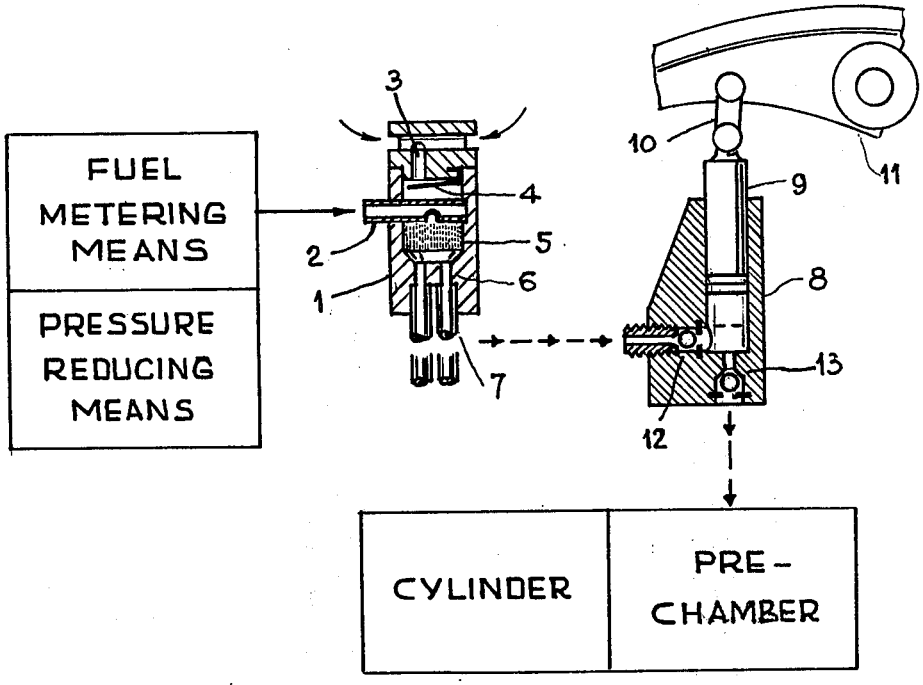
FIG. 1 is a semi-schematic view of a fuel control arrangement including sectional views of distribution elements.
Figure 2:
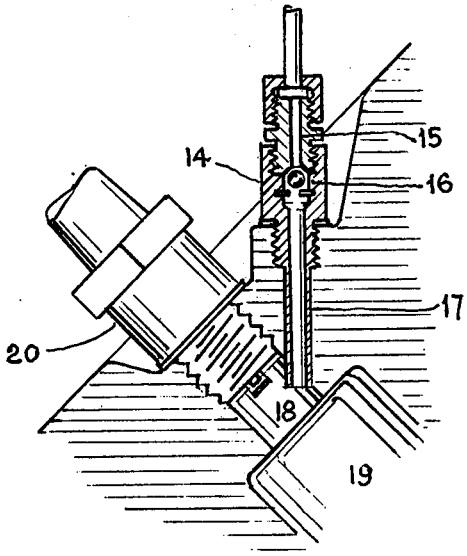
FIG. 2 is a sectional view of a fuel valve installed in an internal combustion engine.

In the first embodiment, shown in FIG. 1, fuel flows from a float bowl or equivalent low-pressure reducing means through metering means in near-continuous flow into receptacle 1. To eliminate or minimize undesirable back-pressures on the fuel metering means the receptacle is connected to ambient air through vent 3 and check valve 4. Fuel sloshing under lateral accelerations is prevented with damper 5. Outlets 6, located in the bottom of the receptacle close to its vertical axis, are connected with manifold 7 to fuel valves 8, which are not vented to ambient air. Plunger 9 is hinged with link 10 to rocker arm 11 and, when lifted, aspirates fuel through check valve 12. The plunger will also aspirate different amounts of complementary air, its constant displacement being larger than the varying amounts of fuel increments accumulated in the receptacle between intake strokes, during which the plunger expulses fuel and air increments through check valve 13 into a cylinder, preferably through a prechamber. The "milking" of fuel and air increments from receptacle 1 by the multiple fuel valves in a multi-cylinder engine occurs sequentially with the aspiration time intervals changing with engine speed and their overlap depending mainly on the number of cylinders. To normalize fluid flow patterns in the receptacle and thereby equalize aspirated fuel quantities, outlets 6 are equidistantly placed in a circle and interconnected through manifold 7 with fuel valves 8 such as to ensure circular succession of the drainages from receptacle 1. The presence of air in the fuel valve affects the timing of fuel expulsion and the joint transfer of fuel and air in this distribution arrangement benefits the subsequent precombustion process. In the second arrangement, shown in FIG. 2, fuel increments are aspirated with fuel valves without mechanical actuation by utilizing pressure differentials between receptacle and each cylinder during intake strokes. Fuel valve 14 aspirates fuel and air through orifice 15 and check valve 16 which is closed during compression, expansion and exhaust strokes, and through tube 17 into neck 18 connecting prechamber 19 with sparkplug 20. The flow of vent air is limited by orifice 15 which is dimensioned for maximum fuel flow under full power/-high engine speed condition. Under full power/low engine speed conditions, as in slow uphill driving in high gear when the pressure differential is smallest, check valve 4 in receptacle 1 of FIG. 1 prevents fuel from flowing out of vent 3 but causes some back pressure affecting the fuel metering means. During all modes of engine operation the ratio of vent air to engine intake air remains small, largest during idling.

Figure 3:
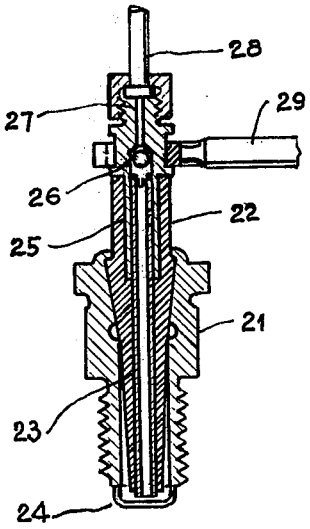
FIG. 3 is a sectional view of a fuel valve and spark igniter combination.

A fuel valve/spark igniter combination is disclosed in FIG. 3. Fuel valve body 21 supports insulator 22 which holds tube 23 serving the dual function of conducting fuel and electrical currents. One or more secondary electrodes 24 at the threaded end of valve body 21 are shaped to disperse fuel increments and assist in their vaporization. Tube 23 is attached to sleeve 25 containing check valve 26 and orifice 27 and providing attachments for line 28 of the fuel manifold and for electrical connector 29. The combination obviates extra openings in the engine head for fuel valves, prepares the fuel for combustion by extracting heat from the fuel valves, disperses aspirated fuel and gases with the secondary electrodes while cooling and cleaning them.

I claim:

1. In an internal combustion engine having fuel pressure regulation means, fuel metering means, a plurality of cylinders, each of said cylinders having a fuel valve with a plunger aspirating and expulsing increments of fuel and complementary vent air, an arrangement for fuel distribution comprising in combination:

a receptacle for receiving fuel from said fuel metering means and vent air, for equal apportioning and sequential release of said increments of said fuel and said vent air in response to successive aspirations by said fuel valves, including an inlet for admitting said fuel, a vent for admitting said vent air, means for preventing fuel sloshing, a plurality of outlets evenly spaced in circular arrangement in the bottom of said receptacle;

a manifold with lines for transmitting said increments from said outlets to said fuel valves, said lines connected to ensure circular succession of the releases of said increments from said receptacle.

2. In an internal combustion engine having fuel pressure regulation means, fuel metering means, a plurality of cylinders, in each cylinder a piston performing intake, compression, expansion and exhaust strokes, an arrangement for fuel distribution comprising in combination:

a receptacle for receiving fuel from said fuel metering means and vent air, for equal apportioning and sequential release of increments of said fuel and vent air, including an inlet for admitting said fuel, a vent for admitting said vent air, a check valve for preventing fuel flow from said vent, means for preventing fuel sloshing, a plurality of outlets evenly spaced in circular arrangement in the bottom of said receptacle;

a plurality of fuel valves, each connected to one of said cylinders, for aspirating said increments in response to pressure differentials between said receptacle and each of said cylinders during each of said intake strokes of said pistons, each including an orifice for limiting the flow of said vent air, a check valve to prevent backflow from the cylinder;

a manifold with lines for transmitting said increments from said outlets to said fuel valves, said lines connected to ensure circular succession of the releases of said increments from said receptacle.

3. An arrangement for fuel distribution as claimed in claim 2 in which each of said fuel valves includes valve body and means for spark ignition including an insulator mounted therein, a sleeve for attaching an electrical connector and said fuel line from said receptacle, tubular primary electrode for conducting ignition currents and flows of said increments of fuel and vent air, and at least one secondary electrode on said valve body formed for dispersing said increments emitting from said tubular primary electrode.

* * * * *